US005799945A

United States Patent [19]

Boylan et al.

[11] Patent Number: 5,799,945

[45] Date of Patent: Sep. 1, 1998

[54] METHOD OF PLAYING A POKER-TYPE WAGERING GAME

[75] Inventors: Eugene B. Boylan, Minden; Robert F. Koerner, Gardnerville; Russell R. Hebert, Carson City, all of Nev.

[73] Assignee: Bet Technology Inc., Carson City, Nev.

[21] Appl. No.: 893,242

[22] Filed: Jul. 16, 1997

[51] Int. Cl.[6] ..... A63F 1/00

[52] U.S. Cl. ..... 273/292

[58] Field of Search ..... 273/292, 274, 273/309; 463/12, 13

[56] References Cited

U.S. PATENT DOCUMENTS

| | | | |
|---|---|---|---|
| 5,098,107 | 3/1992 | Boylan et al. | 273/292 |
| 5,377,993 | 1/1995 | Josephs | 273/292 |
| 5,660,393 | 8/1997 | Dreger | 273/292 |

*Primary Examiner*—Benjamin H. Layno
*Attorney, Agent, or Firm*—Larson & Taylor

[57] ABSTRACT

A method of playing a poker-type wagering game whereby, in each round of play, a plurality of outcomes for each respective player to wager against a dealer are available or offered. These outcomes are: (a) that the player has a two card hand of the same suit; (b) that the player has a two card hand which ranks higher than a dealer's two card hand; and (c) that the player has a poker hand with a poker value of greater than a predetermined value, the poker hand being comprised of two card hand of the respective player, the two card hand of the dealer, and a common card. After making an ante bet by each respective player against the dealer for a selected one, or preferably at least two, of the plurality of outcomes, the dealer deals two cards to each respective player and himself and a single card which is designated as the common card. In turn, the dealer then first determines whether each betting player has a respective hand of two cards of the same suit and pays off winning hands. Next, the dealer determines whether a betting player has a respective two card hand which ranks higher than the two card hand of the dealer and pays off winning hands. Finally, the dealer determines whether a betting player has a five card poker hand which has a poker value higher than the predetermined value and pays off winning bets.

10 Claims, 1 Drawing Sheet

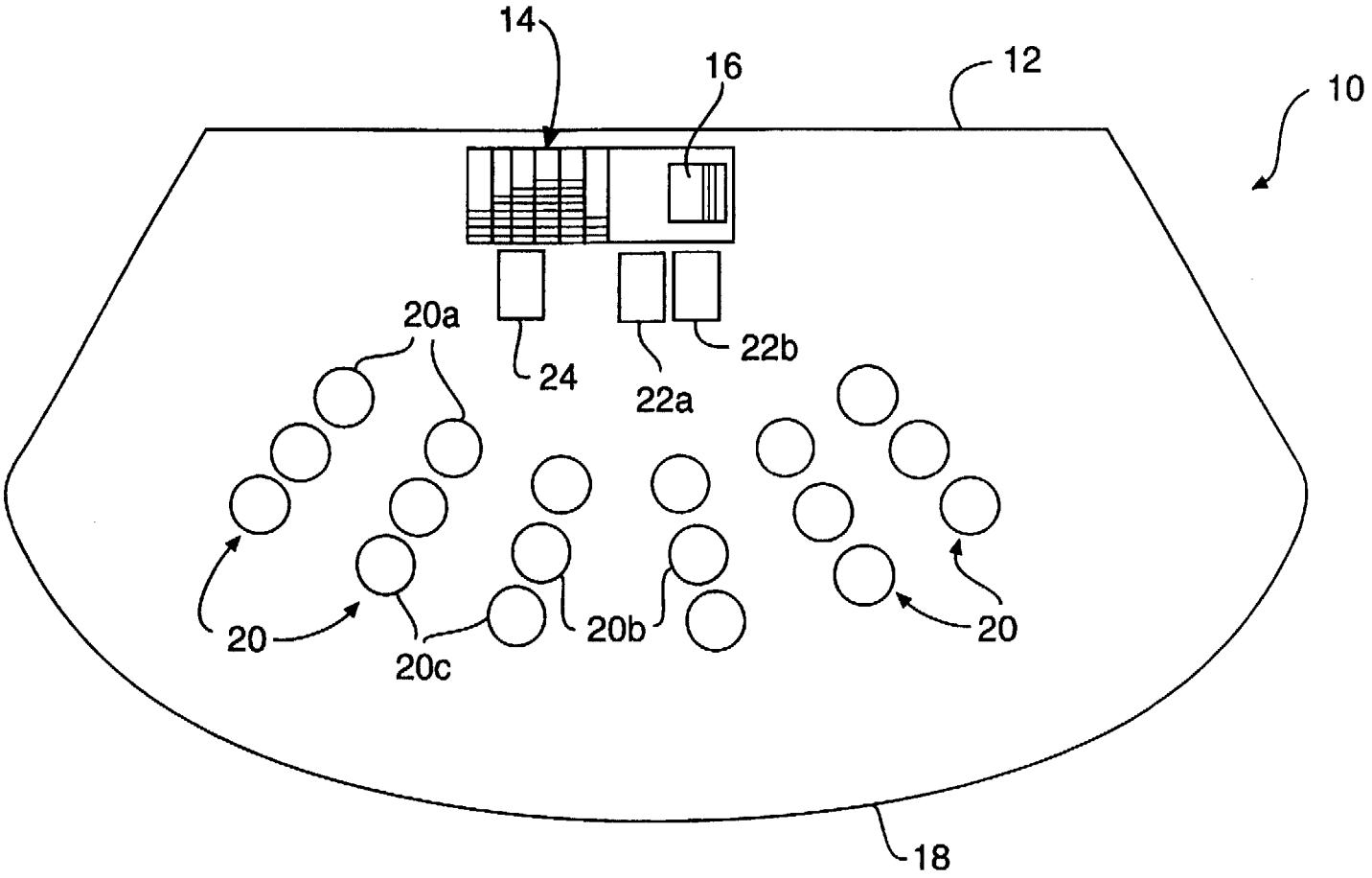
10
12
14
16
18
20
20a
20b
20c
22a
22b
24

METHOD OF PLAYING A POKER-TYPE WAGERING GAME

FIELD OF THE INVENTION

The present invention relates generally to a poker-type wagering game, and more particularly to such a game in which each player is afforded the opportunity to make a plurality of wagers against a dealer at each round of play.

BACKGROUND OF THE INVENTION

Games in which wagers are made based on the outcome of randomly (chance) generated or selected symbols have wide appeal. Such games include various card games as well as other games where there are randomly generated or selected symbols. Poker is one such game with very wide appeal and which is understood by many people. However, traditional poker is generally not well suited to banked wagering games such as used in casinos, where it is desired for a dealer to control all play and for all wagers to be made against the dealer.

In banked wagering games of the casino type, it is generally desired for play to be short and simple so that the house take will be increased as the number of rounds of play per unit of time increases. It is also desired for such banked wagering games that the players be afforded opportunities for additional bets, in order to increase interest in the game - with the additional benefit of increasing the house take as more wagering occurs. The use of new games also attracts the interest of players looking for something new to try, particularly where the rules of the new game are derived from a known game such as poker.

SUMMARY OF THE INVENTION

In accordance with the present invention, a new and simple method of playing a poker-type wagering game is provided. The wagering game is played between a respective player or a group of respective players, and a dealer, with the outcome determined by randomly generated playing cards having various ranks and suits and the rules of poker or the like being used to determine the winner and loser between each respective player and the dealer. At the start of each round of play of the wagering game, a plurality of outcomes for each respective player to wager against a dealer are available or offered. These outcomes are: (a) that the respective player has a hand of two cards of the same suit; (b) that the respective player has a hand of two cards which ranks higher than a hand of two cards of the dealer; and (c) that the respective player has a poker hand with a poker value of greater than a predetermined value, the poker hand being comprised of five cards including the two card hand of the respective player, the two card hand of the dealer, and a common card. Before play begins, an ante bet is wagered by each respective player against the dealer for a selected one of the plurality of outcomes, or preferably against at least two or three of the selected outcomes. After all bets are made, the dealer deals: (a) two cards to each respective player to constitute the hand of that player; (b) two cards to the dealer to constitute the hand of the dealer; and (c) a single card which is designated as the common card.

After all cards are dealt, the dealer first determines in turn, for each respective player making an ante bet that the respective player has a respective hand with two cards of the same suit, whether that player has a respective hand of two cards of the same suit. If the player does have a winning hand, the dealer pays off the ante bet of each respective player which does have a respective hand of two cards of the same suit. Next, the dealer determines in turn, for each respective player making an ante bet that the respective player has a respective two card hand which ranks higher than the two card hand of the dealer, whether that player has a respective two card hand which ranks higher than the two card hand of the dealer. If the player does have a winning hand, the dealer pays off the ante bet of each respective player which does have a respective two card hand which ranks higher than the two card hand of the dealer. Finally, the dealer determines in turn, for each respective player making an ante bet that the respective player has a five card poker hand which has a poker value higher than the predetermined value, whether that player has a five card poker hand which has a poker value higher than the predetermined value. If the player does have a winning hand, the dealer pays off the ante bet of each respective player which does have a five card poker hand greater than the predetermined value.

In accordance with a preferred embodiment of the present invention, the predetermined value for the poker hand is a pair of tens or better. In addition, the determining and paying off of the ante bet for a hand of two cards of the same suit includes the determining of whether the two card hand of each respective player having two cards of the same suit is comprised of a king and queen of the same suit, and the paying off an increased amount over the payoff of the ante bet where the respective player has a king and queen of the same suit. For added interest, the playing cards include a joker which is considered a wild card. Then, each determining step includes the step of allowing each respective player to designate what suit the joker is to be considered for each determining step and additionally what value the joker is to have for the determining of the rank of the two card hand of the respective player and the rank of the five card hand of the respective player.

In the preferred embodiment, the dealing step includes the steps of dealing the two cards of each respective player face up and the dealing of the two card hand of the dealer and of the common card face down. Then, the determining step of the rank of the two card hand of the dealer includes the step of turning the two cards of the hand of the dealer face up; and the determining step of the rank of the five card hand includes the step of turning the common card face up.

It is a advantage of the present invention that a wagering game is provided which is simple and easy to understand, using rules which many people are already at least somewhat familiar with.

It is also an advantage of the present invention that a wagering game is provided which generates increased interest and participation.

It is another advantage of the present invention that the wagering game presents the player with multiple opportunities to wager during each round of play.

Other features and advantages of the present invention are stated in or apparent from detailed descriptions of presently preferred embodiments of the invention found hereinbelow.

BRIEF DESCRIPTION OF THE DRAWINGS

The single figure is a schematic representation of a display surface for the poker-type wagering game of the present invention.

DESCRIPTION OF THE PREFERRED EMBODIMENTS

With reference now to the drawing in which like numerals represent like elements, a display surface 10 is depicted on which the poker-type wagering game of the present invention is preferably played as a casino or banked wagering game. Display 10 includes a long flat side 12 along which the dealer is positioned. The dealer controls the play of the game, and in particular the play of each round. Adjacent side 12 is a bank or setting means 14, typically containing a number of different value tokens or the like in ordered rows as depicted. Adjacent bank 14 is a deck 16 containing one (or more, if desired) deck of playing cards from which the dealer deals cards one at a time. Preferably, there is one joker included in the cards (for each deck of cards).

In front of the dealer and along side 18 there are a plurality of betting regions 20. In this embodiment, there are six betting regions 20 so that six players can play the wagering game at a time. Obviously, fewer or greater numbers of players are possible, and it is not necessary for there to be a player for each betting region 20. Each betting region 20 includes three separate betting areas 20*a*, 20*b* and 20*c*. Each betting region 20 thus affords each player the opportunity to make three separate wagers for each round of play. The three separate wagers are for the following outcomes: (a) that the respective player has a hand of two cards of the same suit; (b) that the respective player has a hand of two cards which ranks higher than a hand of two cards of the dealer; and (c) that the respective player has a poker hand with a poker value of greater than a predetermined value, the poker hand being comprised of five cards including the two card hand of the respective player, the two card hand of the dealer, and a common card. Preferably betting areas 20*a*, 20*b*, and 20*c* would include suitable indicia designating which betting area corresponds to which bet.

According to the method of play of the poker-type wagering game of the present invention, a round of play of the game is initiated by the dealer offering each respective player the opportunity to place a wager for one or more of the respective outcomes possible by the placement of a wagering token or ante in the respective betting area 20*a*, 20*b* or 20*c* of wagering region 20. Preferably, each player is required to wager at least two ante bets on any two of the selected outcomes. After the wagers are made, the dealer deals cards in turn from deck 16 as follows: (a) two cards to each player which are placed in front of the betting region 20 of that player, (b) two cards to the dealer which are placed in card areas 22*a* and 22*b*, and (c) a single card to card area 24, which card is designated as the common card. Preferably, the cards dealt to each player are dealt face up, while the cards dealt to the dealer and the common card are dealt face down.

After the required cards are all dealt, the dealer determines in turn, for each player having placed an ante bet in betting area 20*a*, whether the two cards of that player are of the same suit. If the cards are of the same suit, and a joker is automatically considered to be of the same suit, then the player receives a pay off of 2½ times the amount of the ante bet. Additionally, to generate additional interest, the dealer also determines if the cards of the same suit are a king and a queen. If the two cards are a queen and king (note, a joker is not permitted to be a king or queen for the purposes of this wager), then the player receives a pay off of 15 to 1. Obviously, if the two cards of the hand of the player are not of the same suit, the dealer collects the ante bet and deposits it in bank 14. For this wager, the winning percentage is 0.264151, the odds are 3.86, and thus the theoretical hold is 3.919%.

After all of the same suit wagers of betting area 20*a* have been determined in turn, the dealer then turns over the two cards constituting the two card hand of the dealer located in card areas 22*a* and 22*b*. Next, the dealer determines in turn, for each player having placed an ante bet in betting area 20*b*, whether the two card hand of that player has a ranking higher than that of the two card hand of the dealer—any joker being designated by the player to have any suit and rank as desired. Conveniently, the hand rankings are determined using typical poker rankings, though obviously other rankings are also possible such as twenty-one game rankings or the like. If the hand of the player outranks or beats that of the dealer, the dealer pays off the ante bet at even money. If the two card hand of the player is less than or equal to that of the dealer, then the dealer collects the ante wager of that player. For this wager, the winning percentage is 0.497206, the odds are 2.011, and thus the theoretical hold is 0.559%.

After all of the two card wagers of betting area 20*b* have been determined in turn, the dealer then turns over the common card located in card area 24. Next, the dealer determines in turn, for each player having placed an ante bet in betting area 20*c*, whether the five card poker hand of that player has a poker value higher than a predetermined value—any joker being designated by the player to have any suit and rank as desired. Preferably, the predetermined value is a pair of tens or better. If the five card hand of the player has a poker value greater than a pair of tens, the dealer pays off the ante bet at a predetermined payout. Preferably, the pay out is determined by the poker rank of the hand as follows:

| POKER RANK | PAYOFF |
|---|---|
| Royal Flush | 5,000 |
| 5 of a Kind | 1,000 |
| Straight Flush | 250 |
| 4 of a Kind | 125 |
| Full House | 25 |
| Flush | 10 |
| Straight | 5 |
| 3 of a Kind | 3 |
| 2 Pair | 2 |
| 1 Pair (10+) | 1 |

With pay off indicated above, the winning percentage is 0.274171, the odds are 3.647, and thus the theoretical hold is 4.137%.

After the last five card wager is settled, the dealer collects all cards and shuffles deck 16 while offering each player an opportunity to place ante bets again, which will commence another round of play of the wagering game.

While the present invention has been described with respect to exemplary embodiments thereof, it will be understood by those of ordinary skill n the art that variations and modifications can be effected within the scope and spirit of the invention.

We claim:

1. A method of playing a poker-type wagering game between a respective player or a group of respective players and a dealer whose outcome is determined by randomly generated playing cards having various ranks and suits, said method comprising the steps of:

offering of a plurality of outcomes for each respective player to wager against a dealer, the outcomes offered being:

(a) that the respective player has a hand of two cards of the same suit, (b) that the respective player has a hand of two cards which ranks higher than a hand of two cards of the dealer, and (c) that the respective player has a poker hand with a poker value of greater than a predetermined value, the poker hand being comprised of five cards including the two card hand of the respective player, the two card hand of the dealer, and a common card;

wagering an ante bet by each respective player against the dealer for a selected one of the plurality of outcomes;

dealing of two cards by the dealer to each respective player to constitute the hand of that player, dealing of two cards by the dealer to the dealer to constitute the hand of the dealer, and dealing of a single card by the dealer which is designated as the common card;

determining, for each respective player making an ante bet that the respective player has a respective hand with two cards of the same suit, whether that player has a respective hand of two cards of the same suit, and paying off of the ante bet of each respective player which does have a respective hand of two cards of the same suit;

determining, for each respective player making an ante bet that the respective player has a respective two card hand which ranks higher than the two card hand of the dealer, whether that player has a respective two card hand which ranks higher than the two card hand of the dealer, and paying off of the ante bet of each respective player which does have a respective two card hand which ranks higher than the two card hand of the dealer; and determining, for each respective player making an ante bet that the respective player has a five card poker hand which has a poker value higher than the predetermined value, whether that player has a five card poker hand which has a poker value higher than the predetermined value, and paying off of the ante bet of each respective player which does have a five card poker hand greater than the predetermined value.

2. A method of playing a poker-type wagering game as claimed in claim 1 wherein said wagering step includes the wagering of an ante bet by each respective player against the dealer for at least two selected ones of the plurality of outcomes.

3. A method of playing a poker-type wagering game as claimed in claim 2:

wherein said dealing step includes the steps of dealing the two cards of each respective player face up and the dealing of the two card hand of the dealer and of the common card face down;

wherein said determining step of the rank of the two card hand of the dealer includes the step of turning the two cards of the hand of the dealer face up;

wherein said determining step of the rank of the five card hand includes the step of turning the common card face up; and wherein the predetermined value for the poker hand is a pair of tens or better.

4. A method of playing a poker-type wagering game as claimed in claim 3 wherein said determining and paying off of the ante bet for a hand of two cards of the same suit includes the determining of whether the two card hand of each respective player having two cards of the same suit is comprised of a king and queen of the same suit, and the paying off an increased amount over the payoff of the ante bet where the respective player has a king and queen of the same suit.

5. A method of playing a poker-type wagering game as claimed in claim 4:

wherein the playing cards include a joker which is considered a wild card; and wherein each said determining steps includes the step of allowing each respective player to designate what suit the joker is to be considered for each determining step and additionally what value the joker is to have for the determining of the rank of the two card hand of the respective player and the rank of the five card hand of the respective player.

6. A method of playing a poker-type wagering game as claimed in claim 1 wherein the predetermined value for the poker hand is a pair of tens or better.

7. A method of playing a poker-type wagering game as claimed in claim 1:

wherein the playing cards include a joker which is considered a wild card; and wherein each said determining step includes the step of allowing each respective player to designate what suit or value card the joker is to be considered.

8. A method of playing a poker-type wagering game as claimed in claim 1 wherein said determining and paying off of the ante bet for a hand of two cards of the same suit includes the determining of whether the two card hand of each respective player having two cards of the same suit is comprised of a king and queen of the same suit, and the paying off an increased amount over the payoff of the ante bet where the respective player has a king and queen of the same suit.

9. A method of playing a poker-type wagering game as claimed in claim 8:

wherein the playing cards include a joker which is considered a wild card; and wherein each said determining step includes the step of allowing each respective player to designate what suit the joker is to be considered for each determining step and additionally what value the joker is to have for the determining of the rank of the two card hand of the respective player and the rank of the five card hand of the respective player.

10. A method of playing a poker-type wagering game as claimed in claim 1:

wherein said dealing step includes the steps of dealing the two cards of each respective player face up and the dealing of the two card hand of the dealer and of the common card face down;

wherein said determining step of the rank of the two card hand of the dealer includes the step of turning the two cards of the hand of the dealer face up; and wherein said determining step of the rank of the five card hand includes the step of turning the common card face up.

* * * * *